US009281578B2

(12) United States Patent
Kusamaki et al.

(10) Patent No.: US 9,281,578 B2
(45) Date of Patent: Mar. 8, 2016

(54) CONNECTING APPARATUS FOR POWER CABLE

(71) Applicants: Haruki Kusamaki, Toyota (JP); Tetsuya Lida, Nagoya (JP); Hiroyuki Matsuoka, Yokkaichi (JP); Takuya Tate, Suzuka (JP)

(72) Inventors: Haruki Kusamaki, Toyota (JP); Tetsuya Lida, Nagoya (JP); Hiroyuki Matsuoka, Yokkaichi (JP); Takuya Tate, Suzuka (JP)

(73) Assignees: Toyota Jidosha Kabushiki Kaisha, Toyota-shi (JP); Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 14/152,639

(22) Filed: Jan. 10, 2014

(65) Prior Publication Data

US 2014/0199894 A1 Jul. 17, 2014

(30) Foreign Application Priority Data

Jan. 15, 2013 (JP) ..... 2013-004634

(51) Int. Cl.
*H01R 9/24* (2006.01)
*H01R 4/34* (2006.01)

(52) U.S. Cl.
CPC ... *H01R 9/24* (2013.01); *H01R 4/34* (2013.01)

(58) Field of Classification Search
CPC .... H01R 13/42; H01R 13/648; H01R 13/502; H01R 13/207; H01R 13/5219; H01R 13/5221; H01R 29/00; H01R 31/065; H01R 13/64; H01R 13/645; H01R 13/6456; H02M 7/003; H02K 5/22; H02K 5/5225; H02K 15/02
USPC ..... 439/709, 723, 133, 715–718
See application file for complete search history.

(56) References Cited

U.S. PATENT DOCUMENTS

| | | | | |
|---|---|---|---|---|
| 2,882,513 | A * | 4/1959 | Olashaw | 439/682 |
| 6,010,347 | A * | 1/2000 | Lee | 439/222 |
| 7,527,523 | B2 * | 5/2009 | Yohn et al. | 439/564 |
| 7,722,372 | B2 * | 5/2010 | Matsumoto et al. | 439/213 |
| 2009/0023345 | A1 | 1/2009 | Matsumoto et al. | |
| 2011/0187213 | A1 | 8/2011 | Kitagawa et al. | |
| 2014/0015314 | A1 * | 1/2014 | Shiba | 307/9.1 |

FOREIGN PATENT DOCUMENTS

| | | | |
|---|---|---|---|
| CN | 100550528 | C | 10/2009 |
| JP | 2011-177002 | A | 9/2011 |
| JP | 2012-160355 | A | 8/2012 |
| JP | 2012-170172 | A | 9/2012 |

* cited by examiner

*Primary Examiner* — James Harvey
*Assistant Examiner* — Oscar C Jimenez
(74) *Attorney, Agent, or Firm* — Dinsmore & Shohl LLP

(57) ABSTRACT

The cables are configured to supply electric power from an inverter to a motor. The cables include a connector and plural terminals fixed to the connector. A housing of the connector includes a first rib, provided between the adjacent terminals, connecting mutually facing surfaces of the housing. The terminal block is attached to an enclosure of the inverter or motor. The terminal block includes plural retaining walls, each of which encloses and retains a nut. The terminal block includes a second rib connecting adjacent retaining walls. One of the first and second ribs includes a recess. The connector is connected to the terminal block when each of the terminals is fastened to the terminal block with a bolt and the nut. The other of the first and second ribs is disposed in the recess and the ribs intersect when the connector is connected to the terminal block.

6 Claims, 5 Drawing Sheets

CONNECTING APPARATUS FOR POWER CABLE

INCORPORATION BY REFERENCE

The disclosure of Japanese Patent Application No. 2013-004634 filed on Jan. 15, 2013 including the specification, drawings and abstract is incorporated herein by reference in its entirety.

BACKGROUND OF THE INVENTION

1. Field of the Invention

The present invention relates to a connecting apparatus between a terminal block that is attached to an enclosure of an inverter or a motor and power cables that supply electric power from the inverter to the motor.

2. Description of Related Art

An electric vehicle includes a motor for driving, and an inverter that converts direct-current power of a battery into alternating-current power with a suitable frequency for driving the motor. A cable for supplying the electric power from the inverter to the motor is often referred to as a power cable because the cable passes a large current. An enclosure of the inverter is connected to an enclosure of the motor with power cables. A connector is attached to an end of the power cables, while the enclosure of the inverter or the motor is provided with a terminal block that couples with the connector.

The driving motor for the electric vehicle requires a large amount of the electric power in particular. Consequently, each of the power cables has a large diameter and high stiffness, and thus a connecting structure between the connector and the terminal block requires high strength. Accordingly, Japanese Patent Application Publication No. 2011-177002 (JP 2011-177002 A) and Japanese Patent Application Publication No. 2012-160355 (JP 2012-160355 A) disclose the techniques for increasing the strength of the terminal blocks in particular. In the techniques disclosed in JP 2011-177002 A and JP 2012-160355 A, nuts are aligned in the terminal block for fastening the terminal of the connector in the power cable with bolts. In addition, partition panels (JP 2011-177002 A) or ribs (JP 2012-160355 A) are provided between the adjacent nuts to increase strength of the terminal block.

SUMMARY OF THE INVENTION

When a structural strength is increased in general, the size of the connector or the terminal block also increases. The present invention provides a technique for preventing the increase in size and increasing the strength of both the connector and the terminal block, and a technique for limiting the increase in size and securing the strength by taking advantage of structural features of the connector and the terminal block that are fitted with each other.

Aspects of the present invention relate to a connecting apparatus. The connecting apparatus includes power cables and a terminal block. The power cables are configured to supply electric power from an inverter to a motor. The power cables include a connector and a plurality of terminals. The plurality of terminals are fixed to the connector. A housing of the connector includes a first rib. The first rib is provided between the adjacent terminals. The first rib connects mutually facing surfaces of the housing. The terminal block is attached to an enclosure of the inverter or an enclosure of the motor. The terminal block includes a plurality of retaining walls. Each of the plurality of retaining walls encloses and retains a nut. The terminal block includes a second rib for connecting the adjacent retaining walls. One of the first rib and the second rib includes a recess. The connector is connected to the terminal block when each of the plurality of terminals is fastened to the terminal block with a bolt and the nut. The other of the first rib and the second rib is disposed in the recess and the first rib intersects with the second rib when the connector is connected to the terminal block.

The plurality of cable terminals are fixed to the connector in the end of the power cables. In addition, the terminal block connected to the connector is provided with retaining walls that corresponds to each of the plurality of cable terminals and encloses and retains the nut fastening the cable connector with the bolt. In the aspect of the present invention, the connector is provided with the first rib that is provided between the adjacent terminals and connects the mutually facing surfaces of the housing of the connector to increase the strength. On the other hand, the terminal block is provided with second rib for connecting the adjacent retaining walls to increase the strength. In the aspect of the present invention, either one of the first rib and the second rib is provided with the recess, and the first rib and the second rib have the positional relation in which one rib intersects with the recess provided in the other rib when the connector is connected to the terminal block. The reduction of the space where the two ribs occupy can be achieved by intersecting the two ribs. It should be noted that both of the ribs may be provided with the recess, and the positional relation of the two ribs can be determined so that the recesses face and intersect with each other.

The technique described above is particularly effective to the connector in which the plurality of the cable terminals are arranged in a line for the following reasons. When the plurality of the cable terminals are arranged in a line, the connector housing is formed in a long narrow shape. Then, the strength decreases. Providing the first rib that crosses the housing in the vicinity of a near midsection of the connector housing in the longitudinal direction is effective at increasing the strength. On the other hand, the nuts in the terminal block are arranged in a line in accordance with the arrangement of the cable terminals in the connector. In such a structure, the second rib for connecting the adjacent retaining walls of the adjacent nuts extends in the direction of the nut arrangement, that is, the longitudinal direction of the connector housing. Thus, the direction in which the first rib extends intersects with the direction in which the second rib extends, and the advantage in applying the technique disclosed herein can be achieved. A typical case is that electric power is supplied from the enclosure of one inverter to two motors. In this case, at least six cable terminals are arranged in a line in the connector to supply the electric power to each of the two motors. In the terminal block provided in the enclosure of the inverter, six nuts for fastening the cable terminals are arranged in a line, corresponding to the at least six cable terminals. The connector housing is formed in a long narrow shape corresponding to the arrangement of the six nuts in a line. In such connector and terminal block, the ribs described above are effective at securing the strength of the connector.

It should be noted that the technique disclosed herein may be applicable to the connecting structure between the terminal block provided in the enclosure of the inverter and the power cables, or to the connecting structure between the terminal block provided in the enclosure of the motor and the power cables. The connector housing corresponds to a connector that fixes the cable terminals.

Furthermore, the first rib may be provided on a terminal block side rather than in the cable terminal when the connector is connected to the terminal block. Such a structure can reduce the thickness of the connector because the two ribs intersect with each other through the recess in the direction of the connector thickness (the length of the connector housing in the direction of insertion into the terminal block).

The recess provided in the rib can be used for recognizing the direction of the connector when the operator connects the connector to the terminal block. To do this, the recess of the rib may be provided at a position offset from the center of the opening of the connector to the edge of the opening. When the present invention includes such a structure, the recess cannot be fitted into the other rib in position in the case where the direction of the connector is wrong. Therefore, the operator can be prevented from mistaking the direction of the connector.

Details of the technique disclosed herein and further modifications will be described in the following "DETAILED DESCRIPTION OF EMBODIMENTS".

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
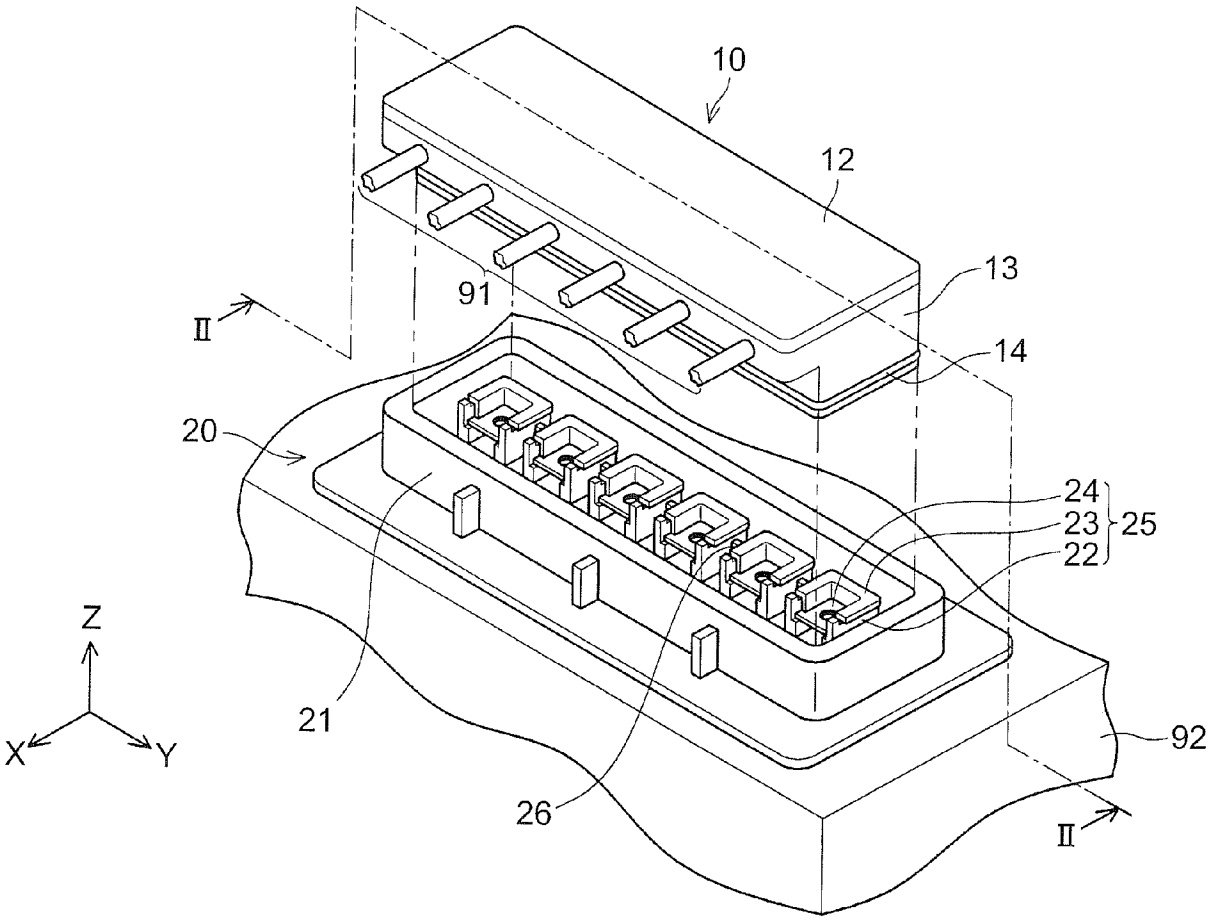
FIG. 1 is a perspective view of a connector and a terminal block.
Figure 2:
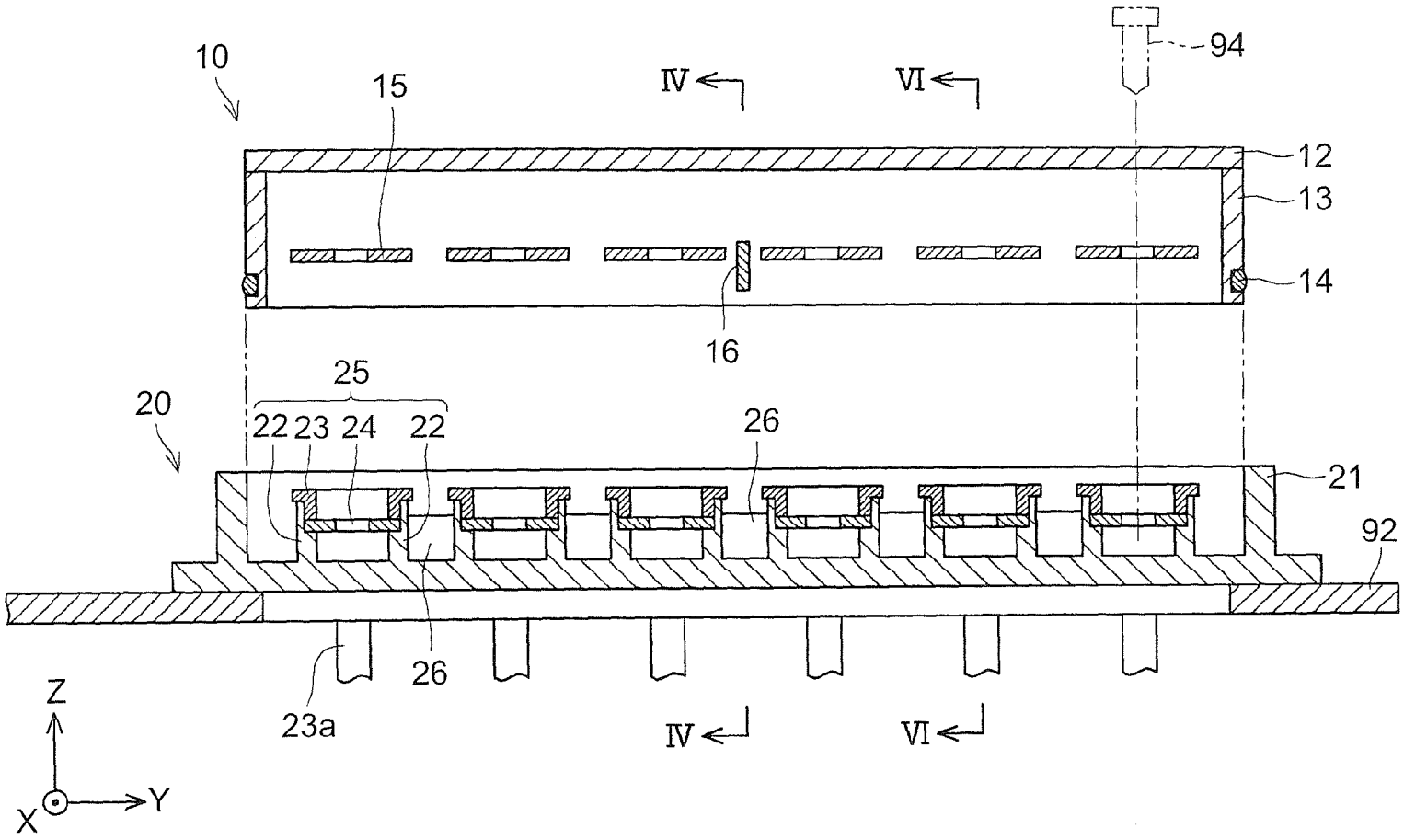
FIG. 2 is a cross-sectional view of the terminal block and the connector that are taken along the line II-II in FIG. 1.

A connecting structure of an embodiment will be described with reference to the drawings. The connecting structure of the embodiment includes a terminal block that is provided to an inverter for an electric vehicle and a connector for power cables that are attached to the terminal block. FIG. 1 shows a perspective view of a connector 10 and a terminal block 20. FIG. 2 shows a cross-sectional view that is taken along the line II-II in FIG. 1. The terminal block 20 is mounted on an inverter 92. The inverter 92 supplies electric power to two motors individually, and thus the connector 10 and the terminal block 20 include six pairs of terminals. Six power cables 91 extend from the connector 10. These power cables 91 are connected to two motors (not shown) with three cables each.

An enclosure of the connector 10 includes a connector housing 13 that fixes cable terminals 15 (see FIG. 2) and a cover 12. The six cable terminals 15 are individually connected to the six power cables 91 in the connector. The connector housing 13 has a cylindrical shape and is fitted into a cylindrical terminal block housing 21 of the terminal block 20. An O ring 14 (ring packing) is fitted around the connector housing 13 for sealing between the connector housing 13 and the terminal block housing 21 when the connector housing 13 is fitted into the terminal block housing 21. The cover 12 is removable from the connector housing 13 in order that a bolt can be inserted when the cable terminal 15 in the connector is fastened to a nut 24 in the terminal block 20. Both of the connector housing 13 and the cover 12 are made of resin.

In the terminal block 20, a set of the nut 24, a bus bar 23, and a retaining wall 22 configures a terminal unit 25. The nut 24 is provided to fix the bolt that fastens the cable terminal 15 in the connector 10 as described above. For reference, the bolt 94 is shown with phantom lines on the extreme right in FIG. 2. When the bolt 94 is fastened, the cover 12 is removed. The nut 24 is enclosed and fixed with the retaining wall 22 together with the terminal block housing 21 as one unit. The retaining wall 22 has a shape of a Greek letter π (or a letter U), and the nut 24 is fixed inside the π-shape. The retaining wall 22 has a function of fixing the nut 24 and also a function of retaining the bus bar 23. The bus bar 23 is a conductor that comes into contact with the cable terminal 15 and transmits the electric power from a circuit in the inverter to one of the power cables. The bus bar 23 is a long narrow plate of metal that has small internal resistance such as copper. An end of the bus bar 23 is extended along inner walls and a top surface of the π-shaped retaining wall 22. When the cable terminal 15 is fastened to the nut 24 with the bolt 94, the end of the bus bar 23 that extends on the top surface of the π-shaped retaining wall 22 comes into close contact with the cable terminal 15, and the bus bar 23 and the cable terminal 15 can conduct. A body 23*a* of the bus bar 23 passes through the terminal block housing 21 and is connected to the circuit (not shown) in the inverter 92.

In FIG. 2, reference numerals are given to only the cable terminal 15 and the terminal unit 25 on the extreme left. Although reference numerals are not given to the other five cable terminals and terminal units, all those components have the same structure as the cable terminal 15 and the terminal unit 25 on the extreme left. In addition, all the cable terminals 15 are fastened to the terminal units 25 (nuts 24) with the bolts 94.

Figure 3:
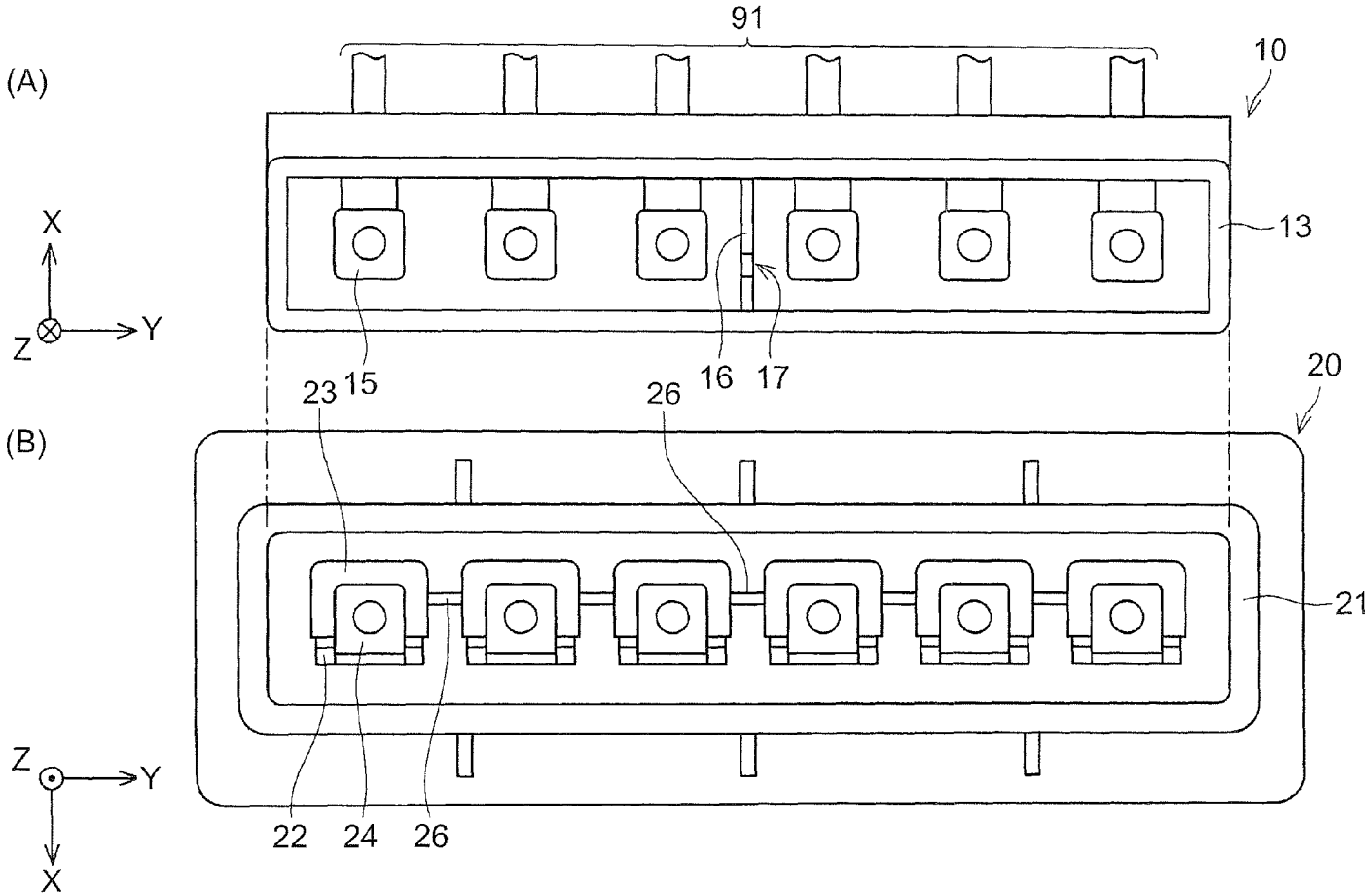
FIG. 3A is a bottom view of the connector.
FIG. 3B is a plan view of the terminal block.

As clearly shown in FIG. 1 and FIG. 2, the six cable terminals 15 in the connector 10 are arranged in a line, and the connector 10 has a long narrow shape. The connector housing 13 is provided with a first rib 16 that crosses the connector housing 13 in a near midsection inside the cylindrical part. FIG. 3A shows a bottom view of the connector 10 (a diagram in which the connector 10 is viewed toward the positive direction of Z-axis in the coordinate system in the drawing). As clearly understood with reference to FIG. 2 and FIG. 3A, the first rib 16 crosses the connector housing 13 in between the two adjacent cable terminals 15 in the midsection of the cylindrical part that has a long narrow opening. The first rib 16 contributes to an increase in strength of the connector housing 13. A recess (notch) 17 is provided in the edge of the first rib 16 that faces the terminal block 20. The recess 17 will be described later.

In the terminal block 20, adjacent retaining walls 22 (terminal units 25) are connected to each other with a second rib 26. The second rib 26 contributes to an increase in strength of the retaining wall 22 (that is, strength of the terminal block 20). FIG. 3B shows a plan view of the terminal block 20 (a diagram in which the terminal block 20 is viewed toward the negative direction of Z-axis in the coordinate system in the drawing). As clearly shown in FIGS. 3A and 3B, the first rib 16 extends along the X-axis in the coordinate system in the drawing, and the second rib 26 extends along the Y-axis. In other words, the first rib 16 and the second rib 26 have a positional relation in which the first rib 16 and the second rib 26 cross each other when the connector 10 is connected to the terminal block 20. In addition, the second rib 26 is arranged inside the recess 17 that is provided in the first rib 16 when the connector 10 is connected to the terminal block 20. The advantage of the recess 17 is described next.

Figure 4:
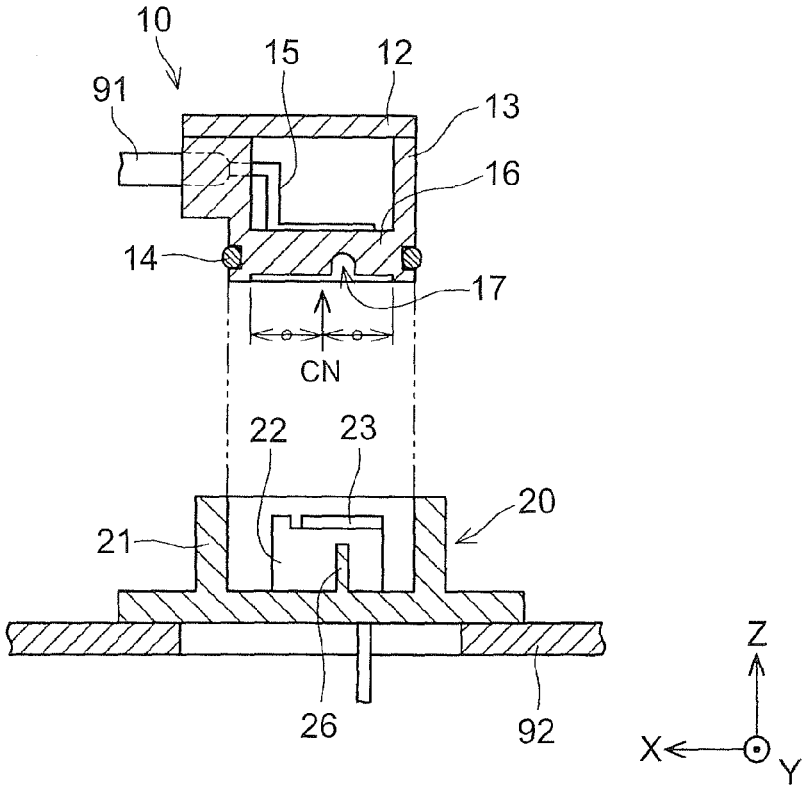
FIG. 4 is a cross-sectional view of the terminal block and the connector that are taken along the line IV-IV in FIG. 2.
Figure 5:
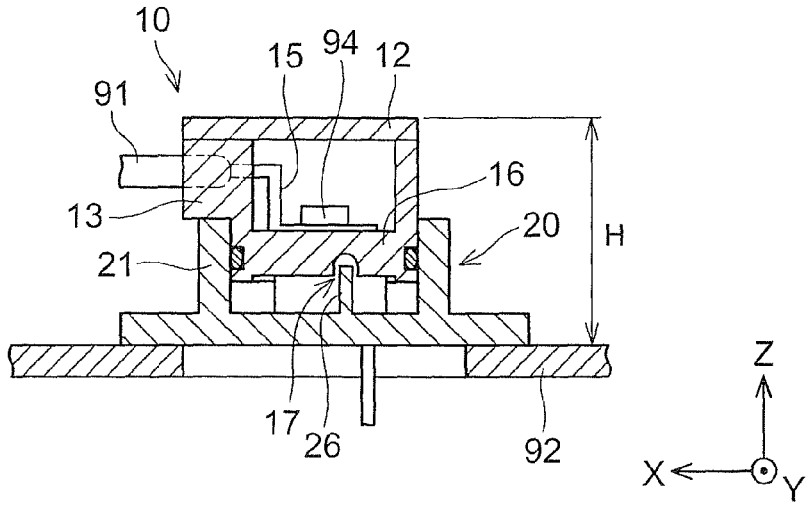
FIG. 5 is a cross-sectional view during the connection of the terminal block and the connector that are taken along the line IV-IV in FIG. 2.

FIG. 4 shows a cross-sectional view that is taken along the line IV-IV in FIG. 2. FIG. 4 also shows a cross section of the first rib 16 which is taken along the longitudinal direction of the first rib 16. In addition, FIG. 5 is a cross-sectional view that corresponds to FIG. 4 and shows a cross section of the connector 10 and the terminal block 20 when they are connected. As described above, when the connector 10 is connected to the terminal block 20, the first rib 16 and the second rib 26 have the positional relation in which one rib (second rib 26) is placed in the recess 17 of the other rib (first rib 16) and one rib intersects with the other rib as seen from the direction in which the connector 10 is connected to the terminal block 20. Consequently, when the connector 10 is connected to the terminal block 20, the first rib 16 and the second rib 26 overlap with each other in a connecting direction of the connector 10 to the terminal block 20. The height of the connector 10 and the terminal block 20 when they are connected (the length shown with a reference symbol H in FIG. 5) can be reduced by the overlap. The recess 17 can restrain the increase in size due to the rib provided for increasing the strength of both the connector 10 and the terminal block 20.

The first rib 16 is placed at the position closer to the terminal block 20 than the cable terminal 15. As clearly shown in FIG. 5, this position is included in a space where the cylindrical part of the connector housing 13 is fitted into the terminal block housing 21 in the insertion direction of the connector 10. In other words, the space where the first rib 16 is placed is an originally necessary space, and thus the increase in space by providing the first rib 16 is limited.

Furthermore, the facts that an upper end of the first rib 16 in FIG. 4 (an edge of the first rib 16 that is positioned farthest from terminal block 20) is placed at the position closer to the terminal block 20 than the cable terminal 15 and does not protrude on the back side of the cable terminal 15 offer the following advantage. The back side of the cable terminal 15 means an opposite surface to the terminal block 20. The bolt 94 (see FIG. 5) is inserted from the back side of the cable terminal 15 for fastening the cable terminal 15 on the terminal unit 25. The first rib 16 does not protrude on the back side of the cable terminal 15, and thus the first rib 16 does not hinder the bolt 94 from fastening. Conversely, when the first rib 16 protrudes on the back side of the cable terminal 15, the clearance between the cable terminals 15 on the sides of the first rib 16 is required to be expanded so that a tool for fastening the bolt 94 does not come into contact with the first rib 16, and the size of the connector 10 and thus the size of the terminal block 20 may increase by the expansion. The first rib 16 does not protrude on the back side of the cable terminal 15, and consequently, the connector 10 and/or the terminal block 20 can be made more compact in size.

On the other hand, the recess 17 that is provided in the first rib 16 has another function. As shown in FIG. 4, the recess 17 is provided at a position offset from the center CN of the opening of the connector housing 13 to the right edge of the opening (right end side of the first rib 16 in the drawing). Thus, when the direction of the connector 10 is wrong, the second rib 26 does not face the recess 17. In this state, the connector 10 cannot fit into the terminal block 20 correctly. Even when the operator tries to attach the connector 10 to the terminal block 20 in the wrong direction, the connector 10 cannot fit into the terminal block 20 correctly, and thus the operator cognize a mistake. That is to say, the installation workability of the connector 10 can be enhanced by providing the recess 17 misaligned from the center of the opening.

Figure 6:
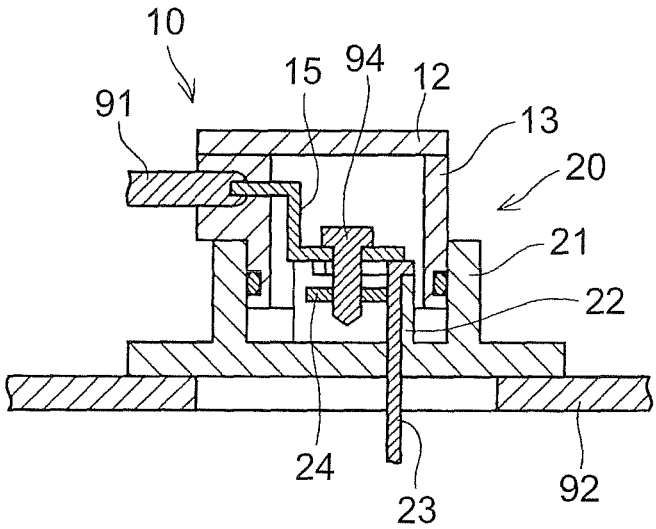
FIG. 6 is a cross-sectional view during the connection of the terminal block and the connector that are taken along the line VI-VI in FIG. 2.

For reference, FIG. 6 shows a cross-sectional view that taken along the line VI-VI in FIG. 2. The cable terminals 15 comes into close contact with the end of the bus bar 23 when fastened to the nut 24 of the terminal block 20 with the bolt, and thus the connector 10 and the terminal block 20 can conduct.

Considerations about the technique described in the embodiment will be described. The connecting structure according to the embodiment is achieved by the terminal block 20 provided in the inverter 92 and the connector 10 in the end of the power cables 91 for supplying the electric power from the inverter to the motor. The connecting structure disclosed herein may be applied to the terminal block provided in the enclosure of the motor and the connector in the end of the power cables. In this case, the structure in which the reference numeral 92 denotes in FIG. 1 through FIG. 6 corresponds to the enclosure of the motor.

In the connector 10 and/or the terminal block 20 of the embodiment, six terminals (the cable terminals 15 and the bus bar 23) are arranged in a line. In such a layout, both of the connector 10 and the terminal block 20 are formed to be long and narrow, and thus the strength is hardly secured. The technique disclosed herein is preferable to the case where the connector and the terminal block has such a long narrow form. However, the technique disclosed herein is not limited to the case where the six terminals are arranged in a line.

In the embodiment, the recess 17 is disposed in the first rib 16 that is provided in the connector housing 13. The recess may be disposed in the second rib 26 that is provided in the terminal block housing 21. The present invention may be configured such that both of the first rib and the second rib are provided with the recesses, and the recess in the first rib intersects with the recess in the second rib when the connector 10 is coupled to the terminal block 20.

In the embodiment, the first rib 16 is provided in the near midsection of the connector housing 13 in the longitudinal direction. However, the position where the first rib 16 is provided is not limited to the position described above.

While the present invention has been described in detail with reference to example embodiments thereof, it is to be understood that those examples are merely illustrative and claims of the present invention are not limited to those examples. The techniques that are disclosed in the claims of the present invention are intended to cover various modifications and changes of the example embodiments that are described above. In addition, the technical elements that are disclosed in the specification and the drawings exhibit technical usefulness alone or in various combinations and configurations, and those are not limited to the combinations and configurations that are disclosed in the claims at the time of filing this application. The techniques that are illustrated in the specification and the drawings can achieve a plurality of objects simultaneously, and the achievement of one object thereof itself has technical usefulness.

What is claimed is:

1. A connecting apparatus comprising:

power cables that are configured to supply electric power from an inverter to a motor, the power cables including a connector and a plurality of terminals, the plurality of terminals being fixed to the connector, a housing of the connector including a first rib, the first rib being provided between the adjacent terminals, and the first rib connecting mutually facing surfaces of the housing; and a terminal block that is attached to an enclosure of the inverter or an enclosure of the motor, the terminal block including a plurality of retaining walls, each of the plurality of retaining walls enclosing and retaining a nut, the terminal block including a second rib for connecting the adjacent retaining walls, one of the first rib and the second rib including a recess, the connector being connected to the terminal block when each of the plurality of terminals is fastened to the terminal block with a bolt and the nut, and the other of the first rib and the second rib being disposed in the recess and the first rib intersecting with the second rib when the connector is connected to the terminal block.

2. The connecting apparatus according to claim 1, wherein the recess is provided in the first rib, and the recess is provided at a position offset to an edge of an opening of the connector from a center of the opening.

3. The connecting apparatus according to claim 1, wherein the first rib is provided closer to the terminal block when the connector is connected to the terminal block than the terminal.

4. The connecting apparatus according to claim 1, wherein the number of the power cables is at least six, the at least the six power cables are configured to supply the electric power from the inverter to two motors, each of the six power cables include the terminal, and the terminal block includes at least six retaining walls that are arranged in a line.

5. The connecting apparatus according to claim 1, wherein the first rib and the second rib cross each other when the connector is connected to the terminal block.

6. The connecting apparatus according to claim 1, wherein the first rib extends in a first direction and the second rib extends in a second direction generally normal to the first direction such that the first rib and the second rib cross each other when the connector is connected to the terminal block.

* * * * *